US007990129B2

(12) United States Patent
Kwak et al.

(10) Patent No.: US 7,990,129 B2
(45) Date of Patent: Aug. 2, 2011

(54) REFERENCE VOLTAGE GENERATING CIRCUIT

(75) Inventors: Joon Young Kwak, Seongnam-si (KR); Yoon-Hee Choi, Anyang-si (KR); Jin-Yub Lee, Seoul (KR); You-Sang Lee, Seoul (KR); Bo-Geun Kim, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 142 days.

(21) Appl. No.: 12/476,565

(22) Filed: Jun. 2, 2009

(65) Prior Publication Data

US 2010/0001710 A1 Jan. 7, 2010

(30) Foreign Application Priority Data

Jul. 1, 2008 (KR) ..... 10-2008-0063596

(51) Int. Cl.
*G05F 3/16* (2006.01)

(52) U.S. Cl. ..... 323/313

(58) Field of Classification Search ..... 323/313, 323/314, 315, 316
See application file for complete search history.

(56) References Cited

U.S. PATENT DOCUMENTS

| | | | | |
|---|---|---|---|---|
| 5,619,124 | A * | 4/1997 | Lim | 323/313 |
| 6,201,437 | B1 * | 3/2001 | Kono et al. | 327/545 |
| 6,642,757 | B2 | 11/2003 | Ikehashi et al. | |
| 7,489,566 | B2 * | 2/2009 | Kang | 365/189.11 |

FOREIGN PATENT DOCUMENTS

| | | | |
|---|---|---|---|
| JP | 07194099 | A | 7/1995 |
| JP | 2002100974 | A | 4/2002 |
| KR | 100153542 | B1 | 7/1998 |
| KR | 1020020023115 | A | 3/2002 |
| KR | 100813550 | B1 | 3/2008 |

* cited by examiner

*Primary Examiner* — Adolf Berhane
*Assistant Examiner* — Yemane Mehari
(74) *Attorney, Agent, or Firm* — Volentine & Whitt, PLLC

(57) ABSTRACT

A reference voltage generating circuit provides a stabilized reference voltage and includes; a clock generator providing a clock signal, a high voltage generator providing a pumping voltage in response to the clock signal, a ripple eradicator providing a static voltage by removing voltage ripple from the pumping voltage, and a reference voltage generator providing the reference voltage.

7 Claims, 7 Drawing Sheets

REFERENCE VOLTAGE GENERATING CIRCUIT

CROSS-REFERENCE TO RELATED APPLICATIONS

This U.S. non-provisional patent application claims priority under 35 U.S.C. §119 to Korean Patent Application No. 10-2008-63596 filed on Jul. 1, 2008, the subject matter of which is hereby incorporated by reference.

BACKGROUND

The present invention relates generally to a reference voltage generating circuit. More particularly, the invention relates to a reference voltage generating circuit having improved output voltage stability.

Many circuits and components within semiconductor devices require one or more reference voltages as part of their various control inputs. Accordingly, conventional semiconductor devices often include specific circuits providing uniform reference voltages. So-called reference voltage generating circuits generally provide a reference voltage (Vref) from an external power source voltage ($V_{DD}$). For stability and reliability in the operation of the constituent semiconductor device, reference voltage generating circuits should output a fixed reference voltage regardless of variations in the operating temperature of the semiconductor device and/or the level of noise apparent on related signal lines and input/output points.

This simple requirement, however, can prove difficult to implement. This is particularly true where the level of the applied external power source voltage varies due to uncontrolled environmental factors, such as temperature. Fluctuations in the external power source voltage often cause instability in the reference voltage output provided by conventional reference voltage generating circuits. Such instability in the generation of one or more reference voltages can adversely affect the reliability and stability of the semiconductor device.

SUMMARY

Embodiments of the invention are directed to a reference voltage generating circuit providing a stable reference voltage.

In one aspect of the invention, a reference voltage generating circuit comprises a clock generator configured to provide a clock signal, a high voltage generator configured to provide a pumping voltage in response to the clock signal, a ripple eradicator configured to provide a static voltage by removing ripples from the pumping voltage, and a reference voltage generator providing a reference voltage derived from the static voltage.

In a related aspect, the ripple eradicator comprises; an input terminal receiving the pumping voltage, an output terminal providing the static voltage, and a plurality of series-connected depletion transistors arranged between the input and output terminals.

In another related aspect, the ripple eradicator further comprises; a selector configured to select one output voltage provided from a source electrode for one of the plurality of depletion transistors, and provide the selected one output voltage as the static voltage.

BRIEF DESCRIPTION OF THE FIGURES

Non-limiting and non-exhaustive embodiments of the invention will be described with reference to the following figures, wherein like reference numbers refer to like or similar elements or features. In the figures.

DESCRIPTION OF EMBODIMENTS

Embodiments of the invention will now be described in some additional detail with reference to the accompanying drawings. The present invention may, however, be embodied in different forms and should not be constructed as being limited to only the illustrated embodiments. Rather, the embodiments are presented as teaching examples.

In this description, unless otherwise defined, all technical and scientific terms used herein have the same meaning as commonly understood by one of ordinary skill in the art to which this invention pertains. The terminology used in the description of the invention herein is for the purpose of describing particular embodiments only and is not intended to be limiting of the invention. As used in the description of the invention and the claims set forth herein, the singular forms "a", "an", and "the" are intended to include the plural forms as well, unless the context clearly indicates otherwise. As used herein, the term "and/or" includes any and all combinations of one or more of the associated listed items.

The term "comprising" as used in this specification and claims means "consisting at least in part of"; that is to say when interpreting statements in this specification and claims which include "comprising", the features prefaced by this term in each statement all need to be present but other features can also be present. Related terms such as "comprise" and "comprised" are to be interpreted in similar manner.

Figure 1:
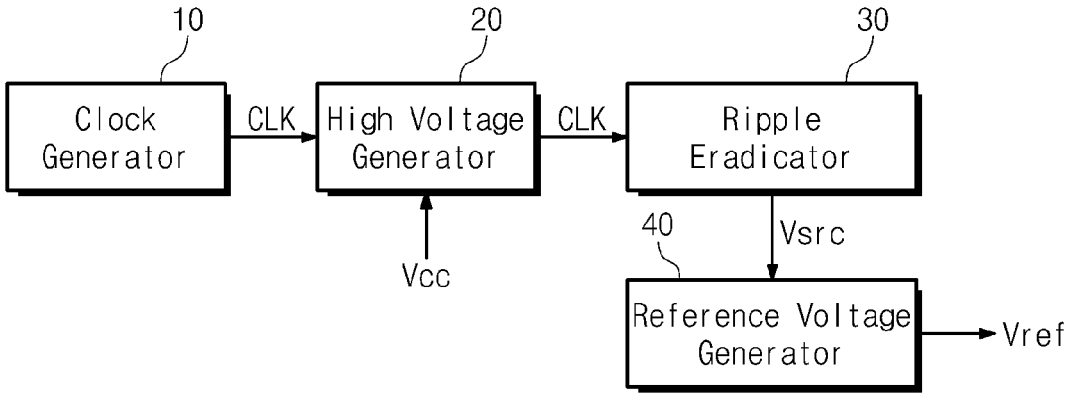
FIG. 1 is a block diagram of a reference voltage generating circuit according to an embodiment of the invention.

FIG. 1 is a block diagram of a reference voltage generating circuit according to an embodiment of the invention.

Referring to FIG. 1, the reference voltage generating circuit comprises a clock generator 10, a high voltage generator 20, a ripple eradicator 30, and a reference voltage generator 40.

The clock generator 10 is configured to provide (e.g., internally generate) a clock signal CLK subsequently applied to the high voltage generator 20. The clock signal CLK is provided with a defined, regular period and may be generated by means of a conventionally understood oscillator circuit.

The high voltage generator 20 is configured to receive the clock signal CLK and provide a pumping voltage Vp. In one embodiment, the pumping voltage Vp may be generated by boosting an applied external power source voltage Vcc in response to the clock signal CLK using conventionally understood boosting circuitry and related control methods. For example, the clock signal CLK may be used to control operation of the high voltage generator 20 (i.e., high voltage generator circuit 20 may operate to provide the pumping voltage Vp when the clock signal CLK is activated).

The ripple eradicator 30 is configured to receive the pumping voltage Vp from the high voltage generator and provide a static voltage Vsrc at a constant level by removing voltage ripples coupled onto the pumping voltage Vp provided from the high voltage generator 20.

The reference voltage generator 40 is configured to receive the static voltage Vsrc as an operating voltage. Accordingly, the reference voltage generator 40 is capable of providing a reference voltage Vref having a very stable output level that does not vary with fluctuations in the applied external power source voltage Vcc.

Figure 2:
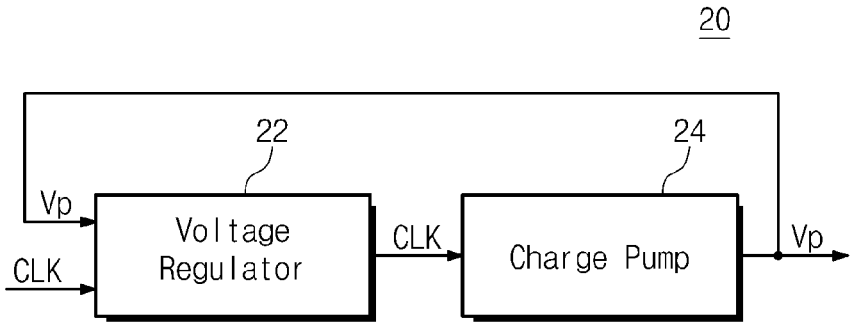
FIG. 2 is a block diagram further illustrating the high voltage generator of FIG. 1.

The high voltage generator 20 of FIG. 1 will now be described in some additional detail with reference to FIG. 2. Referring to FIG. 2, the high voltage generator 20 generally includes a voltage regulator 22 and a charge pump 24.

The voltage regulator 22 is configured to control generation of the clock signal CLK, such that the controlled clock signal CLK serves as a timing input to the charge pump 24, (i.e., in one embodiment, the pumping voltage Vp will rise to a predetermined voltage level in response to the controlled clock signal CLK).

The voltage regulator 22 is configured to determine whether or not a voltage output from the charge pump 24 has reached the pumping voltage Vp, and control the application of the controlled clock signal CLK to the charge pump 24 in accordance with the determination result. In other words, the voltage regulator 22 receives a feedback signal indicative of the pumping voltage Vp from the charge pump 24 and controls the ON/OFF operation of the charge pump 24 in relation to the feedback signal.

In one embodiment of the invention, the charge pump 24 is configured to provide the pumping voltage Vp by increasing (boosting) the applied external power source voltage Vcc in response to the clock signal CLK. The term "external" is used here only to denote the typical origin of the power supply voltage as coming from outside the reference voltage generating circuit. The charge pump 24 may be implemented using a combination of switching elements (not shown) and capacitors (not shown) in conventional fashion and in relation to the clock signal CLK used as a control signal. Many different charge pump designs are possible, but each will be capable of boosting the external power source voltage to the desired pumping voltage Vp. For example, the constituent capacitors of the charge pump 24 may be repeatedly charged and discharged in response to the clock signal CLK until a level of the applied external power source voltage rises to the desired level of the pumping voltage Vp.

The pumping voltage Vp provided by the voltage regulator 24 within the charge pump 20 will usually include voltage ripples due to the aforementioned operation of the voltage regulator 22. That is, even where the voltage output by the charge pump 24 reaches the desired level of pumping voltage Vp, the voltage regulator 22 will continue to oscillate in the generation of the controlled clock signal CLK for some lag period (i.e., some RC delay lag period). For that reason, a voltage higher than the desired level of the pumping voltage Vp will be generated by the charge pump 24 for period of time after the output voltage of the charge pump 24 has reached the pumping voltage Vp. Following this lag period, however, the voltage regulator 22 decreases the output voltage level of the charge pump 24, thereby forcing the output voltage level of the charge pump 24 below the desired level of the pumping voltage Vp.

Through repetition of this UP/DOWN voltage generation operation, ripples are generated on the pumping voltage Vpp provided by the high voltage generator 22. The pumping voltage Vp is said to have a first ripple voltage ($\Delta V_{R1}$). (See, FIG. 4A). Here, the first ripple voltage is assumed to have a greatest voltage difference between maximum and minimum ripple peaks.

The pumping voltage Vp provided by the high voltage generator 20 is applied to the ripple eradicator 30 which seeks to minimize the first ripple voltage $\Delta V_{R1}$.

One embodiment of the ripple eradicator 30 of FIG. 1 will now be described in some additional detail with reference to FIG. 3.

Figure 3:
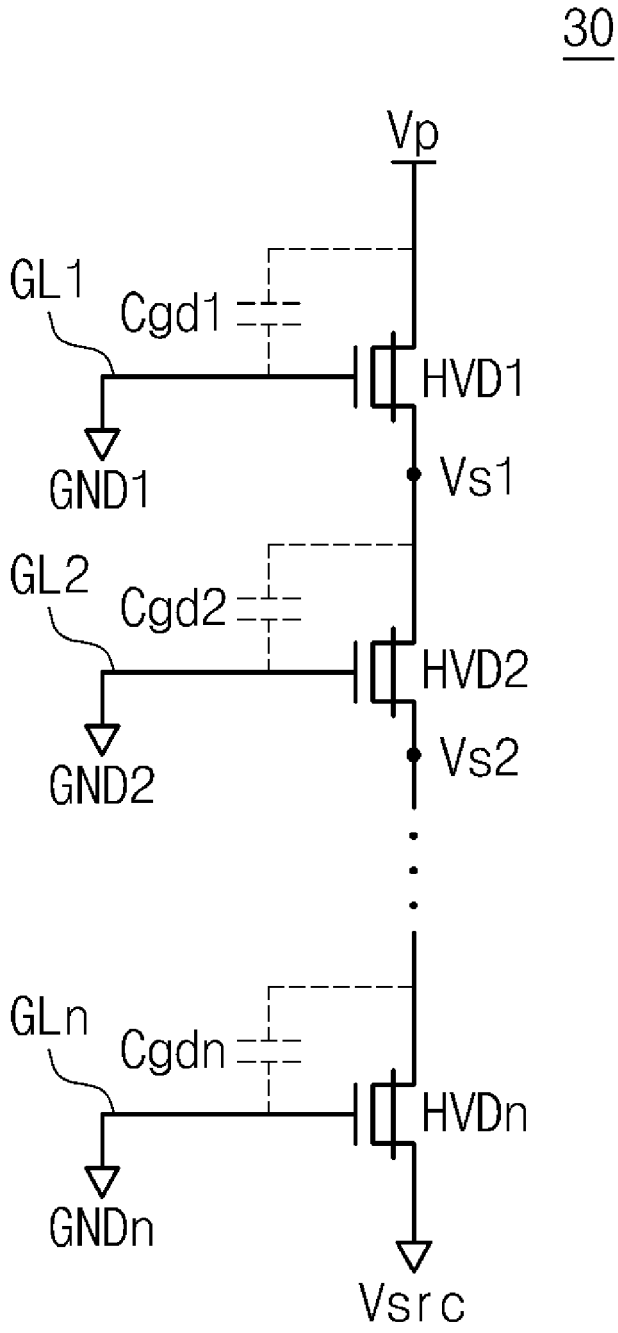
FIG. 3 is a circuit diagram further illustrating one embodiment of the rippled eradicator of FIG. 1.

Referring to FIG. 3, the ripple eradicator 30 comprises a plurality of NMOS depletion transistors (HVD1~HVDn) serially connected between an input terminal receiving the pumping voltage Vp and an output terminal providing the static voltage Vsrc. In other words, the pluralities of the NMOS depletion transistors (HVD1~HVDn) are series connected between the high voltage generator 20 and the reference voltage generator 40 to implement an effective ripple eradicator 30. In one embodiment, the NMOS depletion transistors (HVD1~HVDn may be implemented as high voltage transistors operable at the level of the desired pumping voltage, (i.e., high voltage devices).

Thus, the first NMOS depletion transistor HVD1 may be connected to the high voltage generator 20 through its drain electrode. The source electrode of the first NMOS depletion transistor HVD1 is connected to the drain electrode of the second NMOS depletion transistor HVD2, and so on.

The number "n" of the NMOS depletion transistors (HVD1~HVDn) in the foregoing embodiment may be determined in relation to the anticipated level of the first ripple voltage $\Delta V_{R1}$ apparent on the pumping voltage Vp.

According to the illustrated embodiment of FIG. 3, the respective gate electrodes for the plurality of NMOS depletion transistors (HVD1~HVDn) are each supplied with voltage levels that are stabilized against variations in noise or environmental conditions. In the illustrated embodiment, such "stabilized voltages" are ground voltages (GND1~GNDn). Ground voltages (GND1~GNDn) are coupled to the respective gate electrodes for the plurality of NMOS depletion transistors (HVD1~HVDn) by corresponding ground voltage lines (GL1~GLn). A common ground voltage source may be connected to the ground voltage lines (GL1~GLn) respectively. For the purpose of reducing the influence of certain parasitic capacitances, including the parasitic capacitances (Cgd1~Cgdn) between the drain and gate electrodes of each NMOS depletion transistors (HVD1~HVDn), the ground voltages (GND1~GNDn) may be respectively applied via the individual ground voltage lines (GL1~GLn).

Each one of the plurality of NMOS depletion transistors (HVD1~HVDn) in the illustrated embodiment operates as follows. Each NMOS depletion transistor has a negative value threshold voltage (−Vthd). For instance, the threshold voltages for the NMOS depletion transistors (HVD1~HVDn) may be arranged in the range of from −2.5V to −2V. Each of the plurality of NMOS depletion transistors (HVD1~HVDn) operates in its saturation region when a voltage gap ($V_{DS}$) between the drain and source electrodes is greater than or equal to the voltage gap $V_G$−(−Vthd) between the gate electrode and the threshold voltage.

The source voltages (Vs1~Vsrc) of the NMOS depletion transistors (HVD1~HVDn) may be set on the voltage gap $V_G$−(−Vthd) between the gate voltage and the threshold voltage when the pumping voltage Vp is applied to the first NMOS depletion transistor HVD1. If a power source voltage lower than the absolute value of the threshold voltage is applied to the drain of the NMOS depletion transistor, the NMOS depletion transistor will not be active. For that reason, the pumping voltage Vp is supplied to the drain electrode of the first NMOS depletion transistor HVD1.

Certain operational features of the reference voltage generating circuit in accordance with an embodiment of the present invention will now be described with reference to FIGS. 4A through 4G.

Figure 4A:
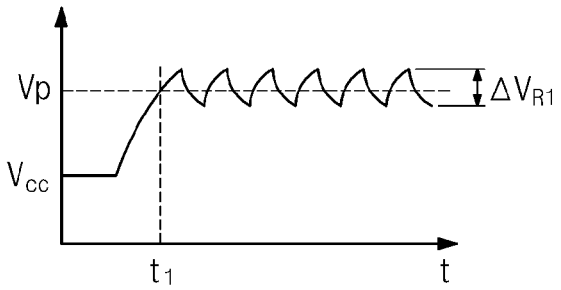
FIGS. 4A through 4G are related waveform diagrams for voltages output from the reference voltage generating circuit of FIG. 1.

Referring to FIG. 4A, initially when there is no generation of the clock signal CLK with a regular cycle period from the clock generator 10, the high voltage generator 20 operating by the power source voltage Vcc outputs a level of the power source voltage Vcc.

Then, as shown in FIGS. 4B through 4G, while the high voltage generator 20 is outputting the level of the power source voltage Vcc, the voltages (GND1~GNDn) and (Vs1~Vsrc) at the gate and source electrodes of the NMOS depletion transistors (HVD1~HVDn) of the ripple eradicator 30 are maintained on the ground voltage (0V).

Thereafter, as the clock generator 10 provides the high voltage generator 20 with the clock signal CLK in a regular cycle period, an output voltage from the high voltage generator 20 rapidly rises up to the pumping voltage Vp from the power source voltage Vcc. Here, the pumping voltage Vp is higher than the absolute value Vthd of the threshold voltage of the NMOS depletion transistor.

When an output voltage from the high voltage generator 20 reaches the pumping voltage Vp, as aforementioned, voltage ripple is generated on the output voltage of the high voltage generator 20. That is, the pumping voltage Vp includes the first ripple voltage $\Delta V_{R1}$.

Figure 4B:
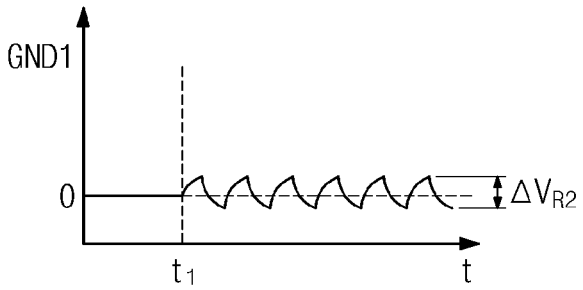
Figure 4C:
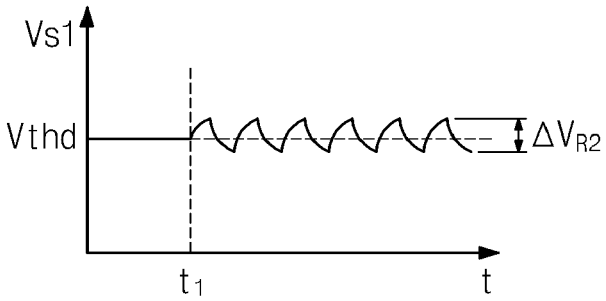
Figure 4D:
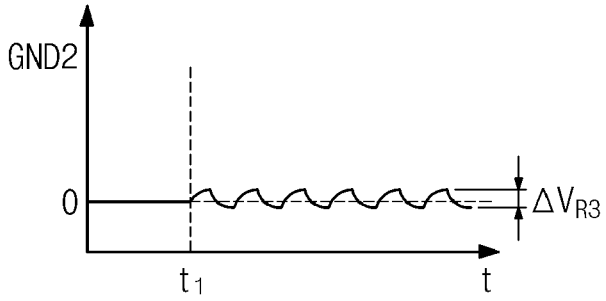

As the high voltage generator 20 outputs the pumping voltage Vp including the first ripple voltage $\Delta V_{R1}$, voltage ripple may also be apparent on the first ground voltage GND1 coupled to the gate electrode of the first NMOS depletion transistor HVD1 due to the parasitic capacitance Vgd1 between the gate and drain electrodes of the first NMOS depletion transistor HVD1. Thus, as shown in FIG. 4B, the first ground voltage GND1 coupled to the gate electrode of the first NMOS depletion transistor HVD1 contains a second ripple voltage $\Delta V_{R2}$. The second ripple voltage $\Delta V_{R2}$ included in the first ground voltage GND1 may be lower than the first ripple voltage $\Delta V_{R1}$ included in the pumping voltage Vp.

As the first ground voltage GND1 coupled to the gate electrode of the first NMOS depletion transistor HVD1 is operating with the second ripple voltage $\Delta V_{R2}$, the source voltage Vs1 of the first NMOS depletion transistor HVD1 becomes the voltage gap $V_G-(-Vthd)$ between the gate electrode and the threshold transistor HVD1 and the second ripple voltage $\Delta V_{R2}$.

When the pumping voltage Vp with the first ripple voltage $\Delta V_{R1}$ is applied to the drain electrode of the first NMOS depletion transistor HVD1 and the first ground voltage GND1 is coupled to the gate electrode of the first NMOS depletion transistor HVD1, the source voltage Vs1 of the first NMOS depletion transistor HVD1 will be set on the threshold voltage Vthd having the second ripple voltage $\Delta V_{R2}$. Under these conditions, the source electrode of the first NMOS depletion transistor HVD1 is charged to a voltage ($Vs1=\Delta V_{R2}+Vthd$) with reduced voltage ripple on the pumping voltage Vp.

The source voltage Vs1 of the first NMOS transistor HVD1 is also able to generate voltage ripple even on the second ground voltage GND2, which is coupled to the gate electrode of the second NMOS depletion transistor HVD2, due to the parasitic capacitance Cgd2 between the gate and drain electrodes of the second NMOS depletion transistor HVD2. Under these conditions, the voltage ripple apparent on the gate voltage of the second NMOS depletion transistor HVD2 becomes smaller than the voltage ripple arising from the source electrode of the first NMOS depletion transistor HVD1. That is, the second ground GND2 coupled to the gate electrode of the second NMOS depletion transistor HVD2 includes a third ripple voltage $\Delta V_{R3}$ less than the second ripple voltage $\Delta V_{R2}$.

Figure 4E:
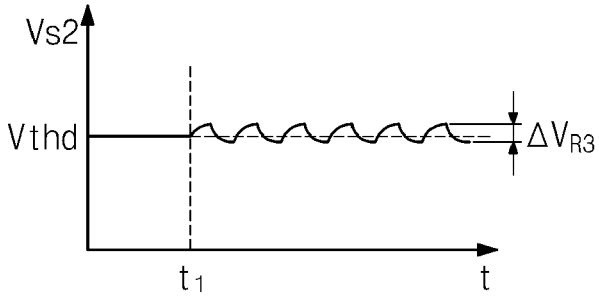

Accordingly, as shown in FIG. 4E, the source voltage Vs2 of the second NMOS depletion transistor HVD2 becomes a sum of the third ripple voltage $\Delta V_{R3}$ and the threshold voltage Vthd of the second NMOS depletion transistor HVD2.

Thereby, the ripple voltage apparent at the drain electrode can be output by reducing at the source electrode through the NMOS depletion transistor. In other words, the first ripple voltage $\Delta V_{R1}$ at the drain electrode of the first NMOS depletion transistor HVD1 gradually falls through the series chain formed by the plurality of NMOS depletion transistors (HVD1~HVDn).

Figure 4F:
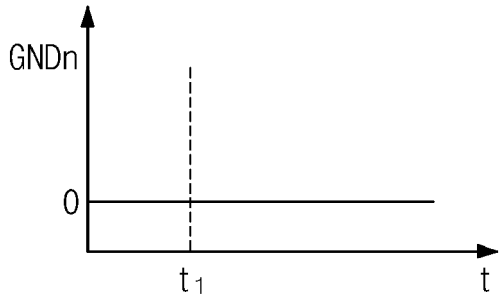
Figure 4G:
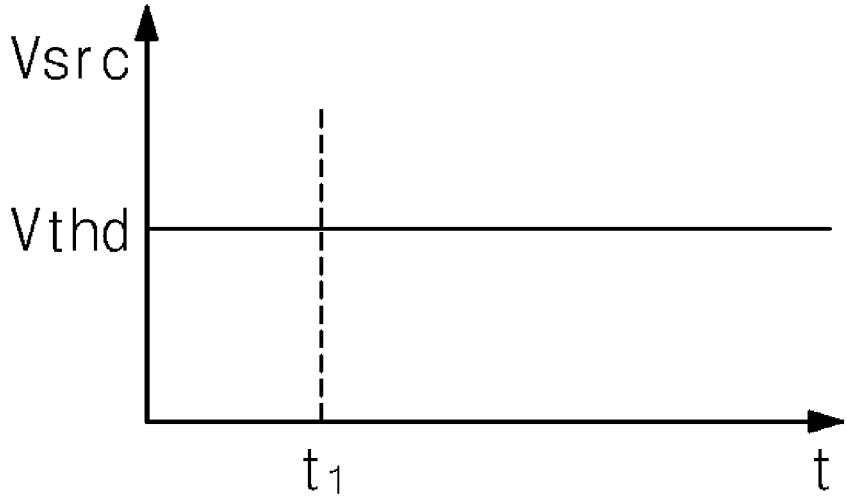

Therefore, as shown in FIG. 4F, there is essentially no voltage ripple apparent on the last ground voltage GNDn coupled to the gate electrode of the Nth NMOS depletion transistor HVDn that is serially connected to the pumping voltage Vp through preceding NMOS depletion transistors (HVD1~HVDn−1). Accordingly, as shown in FIG. 4G, the source voltage Vsrc of the Nth NMOS depletion transistor HVDn, which is finally provided from the ripple eradicator 30 is fixed to the threshold voltage of the Nth NMOS transistor HVDn with a final ripple voltage of 0V.

The voltage output from the source electrode of the Nth NMOS depletion transistor HVDn through the plurality of the NMOS depletion transistors (HVD1~HVDn), (i.e., the threshold voltage Vthd of the NMOS depletion transistor,) is provided to the reference voltage generator 40. Given the foregoing, the reference voltage generator 40 is able to output a reference voltage having a highly stable voltage level corresponding to the threshold voltage Vthd of the Nth NMOS depletion transistor.

Figure 5:
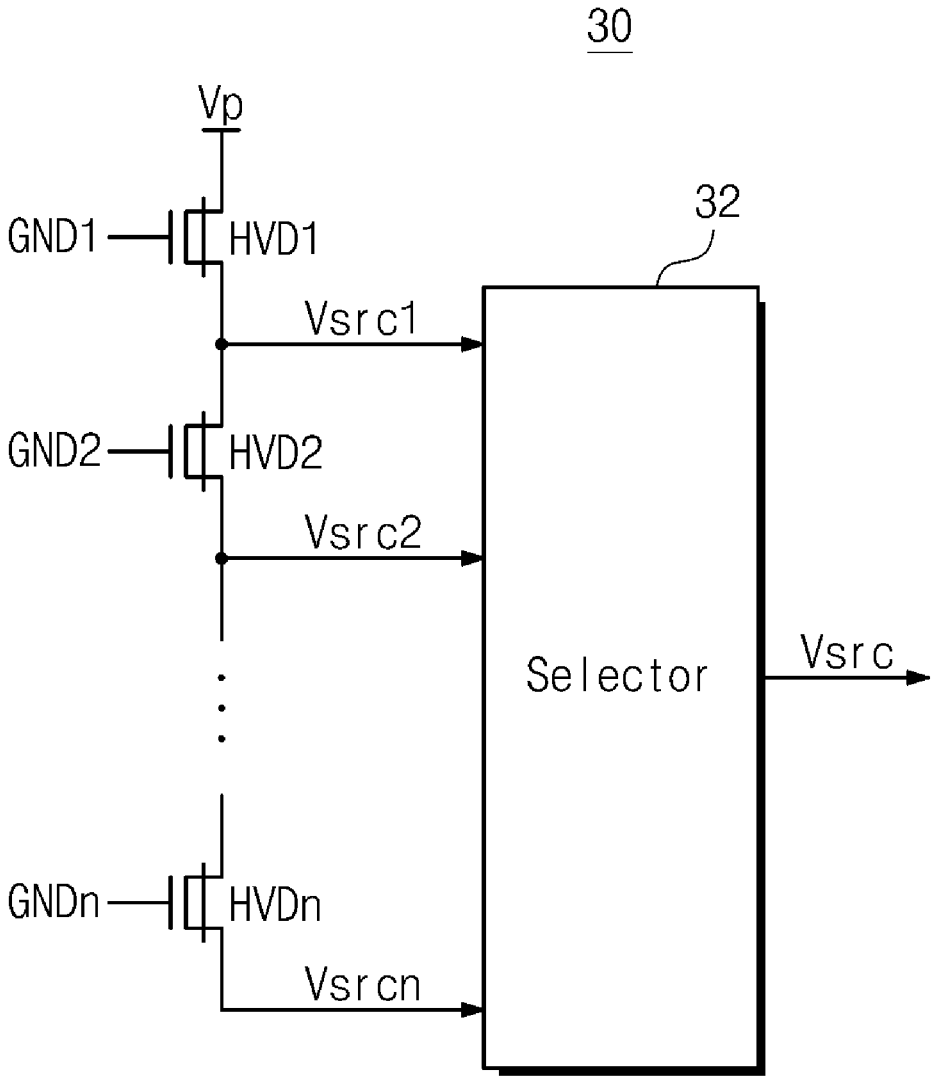
FIG. 5 is a circuit diagram further illustrating another embodiment of the ripple eradicator of FIG. 1.

FIG. 5 is a circuit diagram further illustrating another embodiment of the ripple eradicator 30 of FIG. 1. Referring to FIG. 5, the ripple eradicator 30 comprises the same plurality of NMOS depletion transistors (HVD1~HVDn) as before, but the $1^{st}$ though Nth series arrangement is connected to a selector 32. Within the embodiment of FIG. 5, voltages Vsrc1~Vsrcn may be provided from each of the source electrodes of the NMOS depletion transistors (HVD1~HVDn) to the selector 32.

Since ripple voltage gradually decreases from the first source voltage Vsrc1 to the Nth source voltage Vsrcn, the source voltages Vsrc1~Vsrcn would be arranged with their ripple voltage different from each other as aforementioned.

Then, the selector 32 operates to select and provide one from the "N" source voltages Vsrc1~Vsrcn to the reference voltage generator 40. In this arrangement, the selector is able to select an alternative one from the source voltages Vsrc1~Vsrcn in correspondence with a degree of voltage ripple apparent on the pumping voltage Vp output received from the high voltage generator 20.

If sufficient voltage ripple is removed by a particular one "i" of the plurality of NMOS depletion transistor because the first ripple voltage $\Delta V_{R1}$ included in the pumping voltage Vp is relatively small, then the corresponding voltage Vsrci output from the source electrode of the ith NMOS depletion transistor HVD1 may be selected and output as the static voltage Vsrd.

The above-disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A reference voltage generating circuit comprising:

a clock generator configured to provide a clock signal;

a high voltage generator comprising;

a voltage regulator receiving the clock signal and a pumping voltage feedback signal indicative of a pumping voltage, wherein application of the clock signal by the voltage regulator is controlled according to a level of the pumping voltage feedback signal to generate a controlled clock signal, and a charge pump configured to generate the pumping voltage in response to the controlled clock signal;

a ripple eradicator receiving the pumping voltage and being configured to pass the pumping voltage through a plurality of series-connected NMOS depletion transistors to completely remove a ripple voltage apparent on the pumping voltage to provide a static voltage having substantially zero voltage ripple; and a reference voltage generator providing a reference voltage derived from the static voltage.

2. The circuit of claim 1, wherein each one of the plurality of series-connected NMOS depletion transistors has a gate electrode receiving a ground voltage.

3. The circuit of claim 2, wherein the gate electrode of each one of the plurality of series-connected NMOS depletion transistors receives the ground voltage via a respective ground voltage line.

4. The circuit of claim 2, wherein the ripple eradicator further comprises:

a selector configured to select one output voltage provided from a source electrode of one of the plurality of series-connected NMOS depletion transistors, and provide the selected one output voltage as the static voltage.

5. The circuit of claim 1, wherein each one of the plurality of series-connected NMOS depletion transistors has a negative value threshold voltage.

6. The circuit of claim 5, wherein the negative value threshold voltage ranges between about −2.5 to −2.0V.

7. The circuit of claim 1, wherein each one of the plurality of series-connected NMOS depletion transistors successively provides a source voltage having less ripple than a respectively applied drain voltage, such that the ripple voltage apparent on the pumping voltage is reduced to substantially zero.

* * * * *